United States Patent [19]

McKelvey

[11] 3,999,345

[45] Dec. 28, 1976

[54] SPANDREL UNITS

[75] Inventor: Harold E. McKelvey, Plymouth, Mich.

[73] Assignee: Shatterproof Glass Corporation, Detroit, Mich.

[22] Filed: Nov. 10, 1975

[21] Appl. No.: 630,352

[52] U.S. Cl. ..... 52/309.14; 52/404; 52/616; 428/71

[51] Int. Cl.[2] ..... E04B 2/28

[58] Field of Search ..... 52/616, 404, 309, 235, 52/622; 428/71, 304

[56] References Cited

UNITED STATES PATENTS

| | | | |
|---|---|---|---|
| 3,640,796 | 2/1972 | Cotelle | 52/309 X |
| 3,846,152 | 11/1974 | Franz | 52/616 X |

*Primary Examiner*—Price C. Faw, Jr.
*Assistant Examiner*—Carl D. Friedman
*Attorney, Agent, or Firm*—William E. Nobbe

[57] ABSTRACT

An insulated building element for use as a spandrel in facing the exterior walls of buildings comprising inner and outer spaced parallel sheets or plates of glass sealed together around their peripheral edges to form a dead air space therebetween and a substantially rigid sheet or layer of a foamed or expanded cellular plastic material disposed between the glass sheets and substantially filling the space therebetween. A thin film of a reflective metal may be applied to the inner surface of the outer glass sheet.

6 Claims, 3 Drawing Figures

SPANDREL UNITS

SUMMARY OF THE INVENTION

The present invention relates to a new and improved building element having special utility when used as the facing element in the construction of buildings.

While not restricted to any particular use, the building element of this invention is primarily adapted for use as a spandrel in the construction of the exterior walls of buildings, As is well understood, a spandrel is an exterior wall panel which usually fills the space from the bottom of the window sill to the top of the window below.

Heretofore, spandrels have ordinarily been formed of blocks of stone or concrete, or single panels of glass or metal. However, spandrels of this type have not proven wholly satisfactory in that they do not, themselves, provide good thermal insulation and have to be supplemented by the use of additional insulation for the building walls.

A principle object of this invention is to provide a new and improved insulated spandrel unit for facing the exterior walls of buildings.

Another object of the invention is to provide an improved type of insulated spandrel which affords good thermal insulation as well as giving an attractive appearance to the exterior walls of a building.

A further object of the invention is to provide an insulated spandrel including two spaced parallel sheets or plates of glass sealed together around their peripheral edges to provide a dead air space therebetween and a substantially rigid sheet or layer of a cellular plastic insulating material disposed between the glass sheets and substantially filling the space therebetween.

DESCRIPTION OF THE PREFERRED EMBODIMENT

Figure 1:
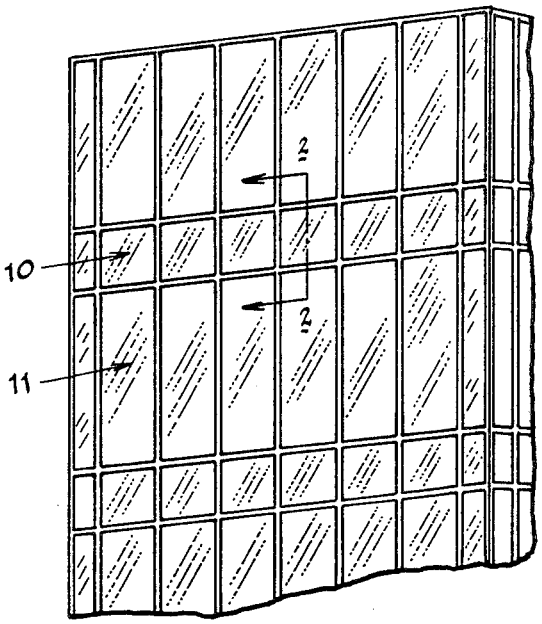
FIG. 1 is a fragmentary view of a portion of the exterior wall of a building showing the relative arrangement of windows and spandrels provided by the present invention.

Referring to the drawings, FIG. 1 illustrates diagramatically a portion of the front wall of a building including spandrels 10 constructed in accordance with the present invention and which are mounted between vertically spaced windows 11. The spandrels 10 and windows 11 are supported by horizontal mullions 12 and spaced from one another by vertical mullions 13 which are suitably attached to the floors or construction beams of the building as indicated at 14. The mullions 12 and 13 are preferably in the form of hollow I-beams to provide channel portions 15 in which the spandrels and windows are mounted.

Figure 2:
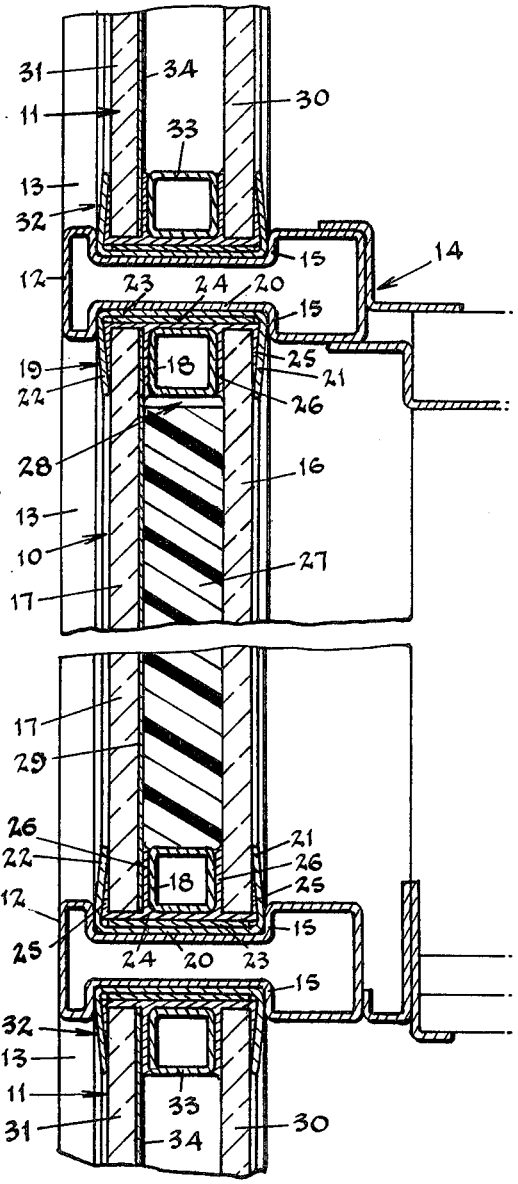
FIG. 2 is a vertical transverse section taken substantially on line 2—2 of FIG. 1.
Figure 3:
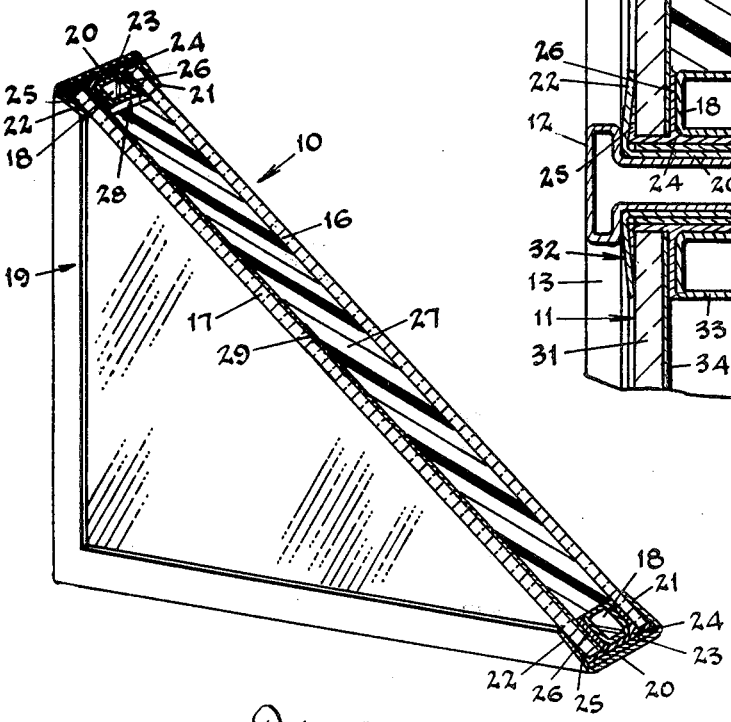
FIG. 3 is a perspective sectional view of the insulated spandrel unit of this invention.

As shown in FIGS. 2 and 3, the spandrel 10 consists of an insulated unit comprised of inner and outer spaced parallel sheets or plates of glass 16 and 17 respectively, preferably tempered, which are held in properly spaced relation by a substantially rectangular hollow spacing member 18 arranged between the glass sheets at their edges. A substantially U-shaped metal frame 19 surrounds the edges of the glass sheets and comprises a base portion 20 disposed opposite the peripheral edges of said glass sheets and bridging the spacing member 18. The base portion 20 of the frame 19 is provided with inwardly directed flanges 21 and 22 which overly the outer marginal faces of the inner and outer glass sheets 16 and 17 respectively and which are adapted to exert a clamping pressure thereon to urge said glass sheets against the spacing member.

An elongated strip of sealing material 23, such as asbestos tape or paper, is used to line the inner side of the base portion 20 of the mounting frame 19 and disposed inwardly of said sealing strip is a layer of a suitable adhesive material 24, such as, for example, polyisobutylene, which also overlaps the outer marginal portions of the glass sheets, as indicated at 25. A thin layer 26 of the adhesive material can also be applied between the spacing member and the glass sheets.

According to the invention, there is disposed between the two glass sheets 16 and 17 a substantially rigid sheet or layer 27 of insulating material consisting of an expanded or foamed cellular plastic material. The cellular plastic materials used include expanded polystyrene plastic material composed of an agglomerate of expanded particles or polystyrene or polyurethane foams in a substantially rigid state so that they are self-supporting.

The space between the inner and outer sheets of glass 16 and 17 may be of any desired width but is preferably in the range of from ¼ inch to 2 inches. The layer of cellular plastic material 27 is of a corresponding thickness so that it fills the space between the glass sheets and preferably contacts the inner surfaces thereof without, however, exerting sufficient pressure thereon as would deform the glass sheets. The vertical and horizontal dimensions of the sheet of plastic material are slightly less than those of the space between the glass sheets to provide a small clearance between the peripheral edges of the sheet of plastic material and the base portion 20 of the mounting frame 19, as indicated at 28, to allow for thermal expansion.

By way of example, a typical spandrel unit embodying the principles of the present invention, consists of two sheets of ¼ inch tempered glass with a ½ inch dead air space therebetween that is essentially filled with a sheet of expanded polystyrene having a density (pcf) of 1.0, a mean test temperature of 40° F, and a K-factor of 0.24. Such a unit has been found by approved testing procedures to have a winter U-factor of 0.334 Btu/hr/ft$^2$/° F based on an outside wind velocity of fifteen miles per hour and an inside wind velocity of zero, and a summer U-factor of 0.325 Btu/hr/ft$^2$/° F based on an outside wind velocity of seven and one-half miles per hour and an inside wind velocity of zero. While expanded polystyrene is ordinarily white in color, it may be painted or dyed black or a dark grey as desired.

The invention also comprehends the provision of a very thin coating of a reflective metal 29, such as, for example, gold or chromium which may be applied to the inner surface of the outer glass sheet 17 in any desired manner such as by the sputter-coating process. While it has been found that this coating does not have any appreciable affect on the insulating qualities of the spandrel unit it does enhance the appearance thereof.

The spandrel unit of this invention is preferably used in combination with double-glazed windows 11 which, as shown in FIG. 2, are comprised of the spaced inner and outer glass sheets 30 and 31 mounted in a frame 32, similar to mounting frame 19 of the spandrel units 10 and maintained in spaced relation by a spacer 33. The windows are also mounted in the horizontal and vertical mullions 12 and 13. By providing the inner surfaces of the outer glass sheets 31 of the windows with a thin coating of a reflective metal similar to that on the inner surfaces of the outer glass sheets of the spandrel units, the exterior wall of the building will have an overall mirror-like appearance.

It is to be understood that the words used herein to describe the invention are words of description rather than of limitation and that the scope of the invention is to be limited only insofar as set forth in the appended claims.

I claim:

1. In a building element, a spandrel unit for facing the exterior walls of buildings, comprising inner and outer sheets of glass, means for mounting the glass sheets in spaced parallel relation to provide a dead air space therebetween, and a substantially rigid sheet of a cellular plastic material loosely received between the glass sheets and substantially filling the space therebetween, at least one major dimension of the sheet of cellular plastic material being relatively less than the corresponding dimension of the space between the glass sheets to allow for thermal expansion of said plastic material.

2. The building element of claim 1, in which the horizontal and vertical dimensions of said cellular plastic sheet are relatively less than those of the space between the glass sheets to allow for thermal expansion of said plastic material.

3. The building element of claim 2, in which the sheet of cellular plastic material consists essentially of expanded polystyrene, foamed polystyrene or foamed polyurethane.

4. The building element of claim 2, in which the inner surface of the outer glass sheet is provided with a thin film of a reflective metal.

5. The building element of claim 1, in which the sheet of cellular plastic material consists essentially of expanded polystyrene, foamed polystyrene or foamed polyurethane.

6. The building element of claim 1, in which the inner surface of the outer glass sheet is provided with a thin film of a reflective metal.

* * * * *